United States Patent [19]

Hayashi

[11] 4,445,471

[45] May 1, 1984

[54] LOW NOISE LEVEL AUTOMOTIVE INTERNAL COMBUSTION ENGINE

[75] Inventor: Yoshimasa Hayashi, Kamakura, Japan

[73] Assignee: Nissan Motor Co., Ltd., Yokohama, Japan

[21] Appl. No.: 302,236

[22] Filed: Sep. 14, 1981

[30] Foreign Application Priority Data

Sep. 17, 1980 [JP] Japan ..... 55-131883[U]

[51] Int. Cl.[3] ..... F02F 7/00; F02B 77/00

[52] U.S. Cl. ..... 123/198 E; 123/195 R; 123/195 A

[58] Field of Search ..... 123/195 R, 195 A, 195 C, 123/195 S, 198 E

[56] References Cited

U.S. PATENT DOCUMENTS

| | | | |
|---|---|---|---|
| 1,996,211 | 4/1935 | Mutchler | 123/195 S |
| 4,071,008 | 1/1978 | Skatsche et al. | 123/198 E |
| 4,213,439 | 7/1980 | Feichtinger et al. | 123/198 E |
| 4,245,595 | 1/1981 | Abe et al. | 123/198 E |
| 4,327,679 | 5/1982 | Crouch et al. | 123/195 C |
| 4,343,271 | 8/1982 | Skatsche et al. | 123/198 E |

FOREIGN PATENT DOCUMENTS

| | | | |
|---|---|---|---|
| 2427474 | 12/1979 | France . | |
| 53-9913 | 1/1978 | Japan | 123/195 C |
| 1328196 | 8/1973 | United Kingdom . | |
| 1600147 | 10/1981 | United Kingdom . | |
| 2074645 | 11/1981 | United Kingdom | 123/195 C |

OTHER PUBLICATIONS

Abstract of Japanese Patent 53-9913, "Patent Abstracts of Japan", vol. 2, No. 50, Apr. 10, 1978, p. 412 M 78.

Abstract of Japanese Patent 53-43148, "Patent Abstracts of Japan", vol. 2, No. 78, Jun. 21, 1978, p. 1862 M 78.

*Primary Examiner*—Ira S. Lazarus

*Attorney, Agent, or Firm*—Schwartz, Jeffery, Schwaab, Mack, Blumenthal & Koch

[57] ABSTRACT

An automotive internal combustion engine comprises a cylinder block formed at its bottom section with a plurality of main bearing carrying sections, a plurality of main bearing caps respectively secured to the main bearing carrying sections, and a beam member formed of a sheet metal and disposed to rigidly connect all the main bearing caps, thereby effectively suppressing the vibration of the main bearing caps to greatly decrease engine noise emission.

10 Claims, 6 Drawing Figures

LOW NOISE LEVEL AUTOMOTIVE INTERNAL COMBUSTION ENGINE

BACKGROUND OF THE INVENTION

1. Field of the Invention

This invention relates to a low noise level automotive internal combustion engine, and more particularly to a cylinder block configuration provided with a beam member for reinforcing main bearing caps to decrease engine noise.

2. Description of the Prior Art

In conventional automotive internal combustion engines, a crankshaft is rotatably supported through main bearing shells by a plurality of main bearing carring sections and bearing caps which are respectively secured to the bearing carrying sections. With this configuration in which each main bearing cap is formed independently, each main bearing cap tends to be vibrated forward and rearward or in the downward direction, by vibrational force applied from the crankshaft due to combustion impact force. This brings about the vibration of the cylinder block skirt section, which causes noise to emit outside of the engine. Such phenomena are particularly prominent in the case of cylinder blocks made of a light alloy.

BRIEF SUMMARY OF THE INVENTION

In accordance with the present invention, an automotive internal combustion engine comprises a cylinder block which is formed at its bottom with a plurality of main bearing carrying sections, and a plurality of main bearing caps respectively secured to the main bearing carrying sections so that the secured main bearing carrying section and the main bearing cap define a cylindrical opening for receiving a crankshaft. All the main bearing caps are rigidly connected with each other through a beam member which is formed of a sheet metal. With this arrangement, the main bearing caps are prevented from easily vibrating in the axial direction of the cylinder block, thereby effectively suppressing noise emission from the cylinder block, particularly via the skirt section of the cylinder block. Besides, by virtue of lightening of engine weight, the natural frequency of the engine body greatly rises and accordingly the engine noise due to low natural frequency can be greatly decreased.

BRIEF DESCRIPTION OF THE DRAWINGS

The features and advantages of the automotive internal combustion engine according to the present invention will be more clearly appreciated from the following drawings in which like references numerals designate like parts and elements, and in which.

DETAILED DESCRIPTION OF THE INVENTION

Figure 1:
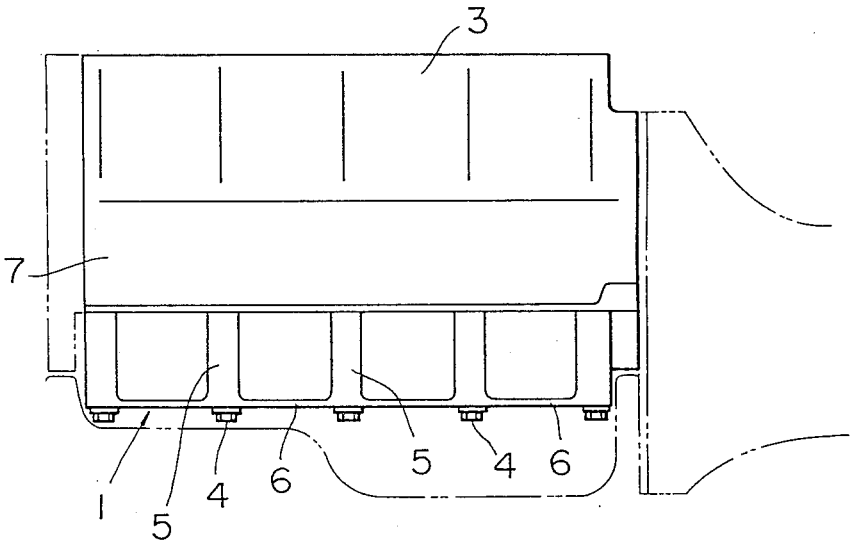
FIG. 1 PRIOR ART
FIG. 1 is a side elevation of a conventional automotive internal combustion engine.
Figure 2:
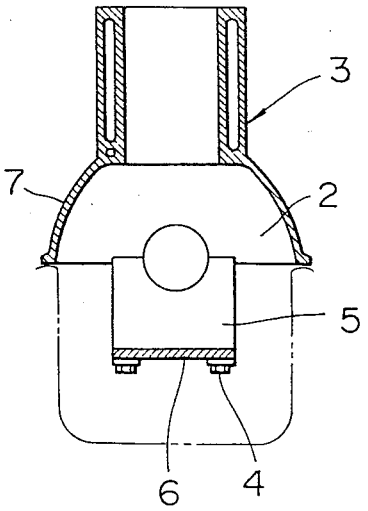
FIG. 2 PRIOR ART
FIG. 2 is a vertical sectional view of the engine of FIG. 1.

In order to overcome the afore-mentioned problem in the conventional automotive internal combustion engine and to obtain a low noise level engine, an engine configuration as shown in FIGS. 1 and 2 was proposed in which an integral and single piece type main bearing cap structure 1 is secured to bearing carrying sections 2 of a cylinder block 3 by means of bolts 4. This bearing cap structure 1 includes a beam section 6 which integrally connects a plurality of bearing cap sections 5. A crankshaft (not shown) is as usual rotatably supported through main bearing shells (not shown) within a cylindrical opening (no numeral) defined by each bearing carrying section 2 and each bearing cap section 5 of the main bearing cap structure 1.

With this arrangement, the vibration of the bearing cap sections 5 in the downward direction are suppressed by virtue of the integral connection through the beam section 6, thereby decreasing noise emitted from the skirt section 7 of the engine. However, since the main bearing cap structure 1 including the bearing cap sections 5 and the beam section 6 are cast as an integral single piece, the engine weight increment due to the beam section 6 is considerable. Thus, any advantageous effect in noise reduction, is offset by the disadvantage due to such an engine weight increment. Besides, since the bearing cap sections 5 are cast integrally with the lengthy beam section 6, deformation is likely to occur due to cavities inside the casting and warp of the casting due to molten metal leaving, volume decrease and the like during the casting of the main bearing cap structure 1. Although such a deformation of the bearing cap structure 1 is liable to occur, locating the bearing cap sections 5 must be located with a considerably high accuracy. Consequently, the production of a suitable main bearing cap structure 1 unavoidably becomes difficult, thereby making production cost high.

Figure 3:
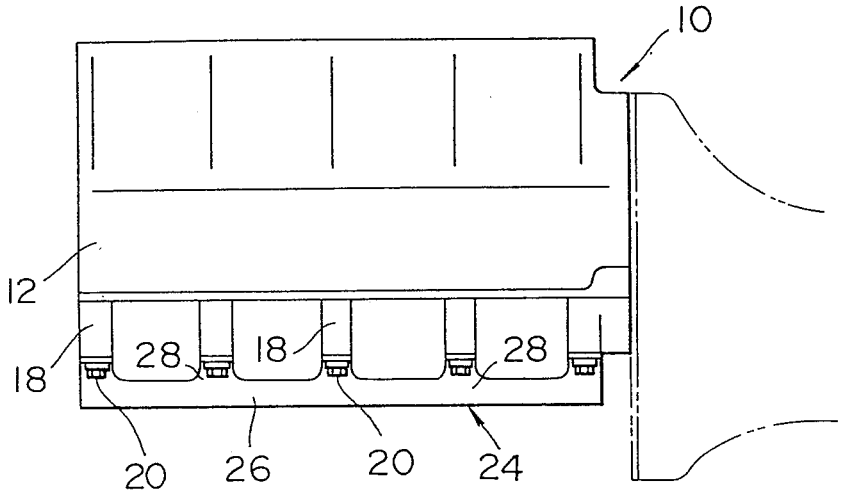
FIG. 3 is a side elevation of an embodiment of an automotive internal combustion engine in accordance with the present invention.
Figure 4:
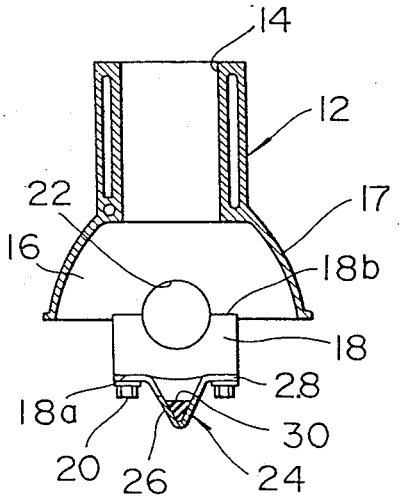
FIG. 4 is a vertical sectional view of the engine of FIG. 3.

In view of the above description of the prior art engine configuration, reference is now made to FIGS. 3 and 4 wherein an embodiment of an internal combustion engine according to the present invention is illustrated by the reference numeral 10. The engine 10 comprises a cylinder block 12 which is formed with an engine cylinder 14 or cylinders, and a plurality of main bearing carrying sections 16 located at the bottom part of the cylinder block 12. The cylinder block 12 is further formed with a skirt section 17 to which an oil pan (not shown) may be connected. A plurality of main bearing caps 18 are secured to the main bearing carrying sections 16, respectively, by means of bolts 20. The main bearing caps 18 are aligned in the direction of the axis of a crankshaft (not shown) and of the cylinder block 12. As shown, a cylindrical opening 22 is defined by each main bearing carrying section 16 of the cylinder block 12 and each main bearing cap 18. It will be understood that the journal of the crankshaft is rotatably supported within the cylindrical opening 22. The two bolts 20 for securing the main bearing cap 18 to the main bearing carrying section 16 are arranged parallel with each other and with the axis of the engine cylinder 14, and located opposite to each other relative to the cylindrical opening 22 in such a manner that the cylindrical opening 22 is interposed therebetween.

A beam member 24 is securely disposed to rigidly connect all the main bearing caps 18. The beam member 24 is formed of a sheel metal and composed of a V-shaped channel section 26 (i.e., an elongate member having a V-shaped cross-sectional), and a plurality of attachment flange sections 28 which are aligned in two rows. The V-shaped channel section 26 and the attachment flange sections 28 are integral with each other. The channel section 26 extents in the direction of the axis of the crankshaft and of the cylinder block 12. As shown, the opposite two attachment flange sections 28 are securely attached, by the bolts 20, to the bottom surface 18*a* of the each main bearing cap 18 which bottom surface is opposite to the bearing cap top surface 18*b* which is securely attached to the bottom surface of the main bearing carrying section 16 of the cylinder block 12. It will be understood that the beam member made of a sheet metal is formed into the shape having a ridge portion which is elongated in the direction of the axis of the crankshaft and of the cylinder block 12 as shown in FIGS. 3 and 4, and therefore the stiffness of the beam member 24 is extremely high though made of a sheet metal. The V-shaped channel section 26 of the beam member 24 is formed by bending a flat sheet metal along a straight line corresponding to the ridge portion. The V-shaped channel section is located lower than the flange sections 28 when installed in position in order to prevent interference with the big ends of the connecting rods (not shown) and the counter weights (not shown) by the V-shaped channel section of the beam member 24. Additionally, the interior of the V-shaped channel section 26 is provided with a damping member 30 made of a material high in damping capacity or high in vibration damping effect. The damping member 30 is securely attached to the inner surface of the V-shaped channel section 26 by baking, adhesion with adhesive, or the like.

With the thus arranged engine construction, when each main bearing cap 18 receives a force causing vibration in the downward direction, the plurality of main bearing caps 18 act with each other to suppress such vibration thereof, so that such vibration of each main bearing cap 18 can be effectively decreased. Besides, since particularly the beam member 24 is light in weight, the total engine weight is decreased and therefore the natural frequency of the engine remarkably increases, thereby greatly decreasing vibration having frequencies of 1 to 2 KHz which contribute to engine noise. Furthermore, by virtue of the vibration damping characteristics of the damping member 30, local resonance vibration can be suppressed and accordingly noise reduction effect is further improved. In addition, since the main bearing caps 18 and the beam member 24 are not integral with each other, the production thereof is not difficult, thereby attaining a reduction in production cost.

Figure 5:
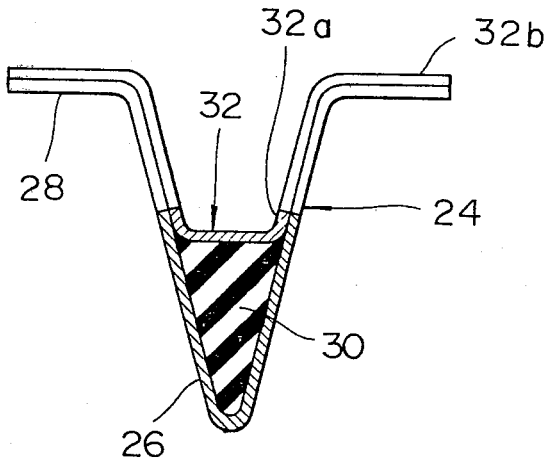
FIG. 5 is a vertical sectional view of a modified example of a beam member used in the engine according to the present invention.

FIG. 5 illustrates a modified example of the beam member construction, in which an auxiliary beam or reinforcing member 32 is placed upon the main beam member 24 to further improve the stiffness of the beam member 24. The auxiliary beam member 32 is composed of a generally C-shaped channel section 32*a*, and a plurality of attachment flange sections 32*b* which are aligned in two rows. As shown, the C-shaped channel section 32*a* is securely attached to the inner surface of the V-shaped channel section 26 of the main beam member 24, whereas the attachment flange sections 32*b* of the auxiliary beam member 32 are securely attached respectively to the flange sections 28 of the main beam member 26. Such secure attachment of the auxiliary beam member 32 and the main beam member 24 is obtained by means of welding, caulking, or the like. Besides, the vibration decreasing effect can be further improved by filling the damping member 30 made of a high damping capacity material, within a space formed between the superposed main and auxiliary beam members 24, 32.

Figure 6:
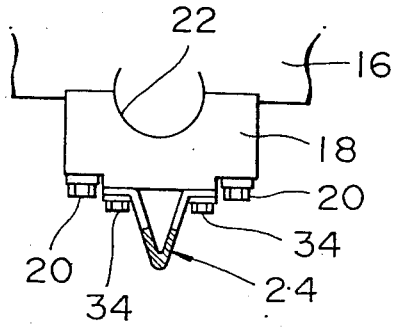
FIG. 6 is a partially cutway view of another embodiment of the engine in accordance with the present invention.

FIG. 6 illustrates a part of another embodiment of the engine according to the present invention. In this embodiment, the beam member 24 is secured to each main bearing cap 18 by bolts 34 other than the bearing cap bolts 20. With this arrangement, the beam member 24 can be installed in position after the engine pistons (not shown), the connecting rods and the like are installed in position, thereby facilitating the assembly of the engine.

As appreciated from the above, according to the present invention, a plurality of main bearing caps are rigidly connected with each other by means of the beam member formed of a sheet metal shaped to obtain high rigidity, the stiffness of the cylinder block against flexure, tortion, and the like can be improved, attaining lightening engine weight. Additionally, the vibrations of the bearing caps are suppressed and therefore the vibration levels of various parts of the engine can be effectively lowered, thereby greatly decreasing noise emission from the skirt section and the like of the cylinder block.

What is claimed is:

1. An automotive internal combustion engine comprising:

a cylinder block having a plurality of mean bearing carrying sections;

a plurality of main bearing caps secured respectively to said main bearing carrying sections to define a cylindrical opening for receiving a crankshaft, and a beam member comprising a metal section secured to said bearing caps to rigidly connect said bearing caps, said beam member having a bend to improve the flexural rigidity of said beam member.

2. An automotive internal combustion engine as claimed in claim 1, wherein said beam member includes a channel section having a ridge which is elongated parallel with the axis of said cylinder block, said ridge being formed by bending a sheet metal along the a straight line parallel with the axis of the cylinder block.

3. An automotive internal combustion engine as claimed in claim 2, wherein said channel section has a V-shaped cross-section being elongated parallel, said channel section with the axis of said cylinder block.

4. An automotive internal combustion engine as claimed in claim 3, wherein said beam member further includes a plurality of attachment flange sections which are aligned in two rows and integral with said channel sections, said beam member being secured at its two opposite attachment flange sections to each main bearing cap.

5. An automotive internal combustion engine as claimed in claim 2, further comprising a damping member made of a material high in damping capacity, and securely disposed inside of said channel section of said beam member.

6. An automotive internal combustion engine as claimed in claim 3, further comprising an elongate reinforcing member which includes a channel section having a generally C-shaped cross-section which channel section contacts said beam member channel section and extends along said beam member channel section, and a plurality of attachment flange sections which contact respectively said beam member attachment flange sections.

7. An automotive internal combustion engine as claimed in claim 4, further comprising bolts for securing the flange sections of said beam member, which bolts are other than bolts for securing each main bearing cap to the corresponding main bearing carrying section of said cylinder block.

8. An automotive internal combustion engine as claimed in claim 1, wherein said bend is produced by bending a sheet metal section.

9. An automotive internal combustion engine comprising:

a cylinder block having a bottom section with a plurality of main bearing carrying sections;

a plurality of main bearing caps secured respectively to said main bearing carrying sections so that the secured main bearing carrying sections and the main bearing caps define a cylindrical opening for receiving a crankshaft, and a beam member comprising a metal section secured to said main bearing caps by bolts to rigidly connect said main bearing caps, said beam member having a bend to improve the flexural rigidity of said beam member in the direction of the alignment of said main bearing caps, said beam member being much higher in flexural rigidity than a flat metal section.

10. An automotive internal combustion engine as claimed in claim 9, wherein said bend is produced by bending a sheet metal section.

* * * * *